US006354178B2

(12) United States Patent
Pool et al.

(10) Patent No.: US 6,354,178 B2
(45) Date of Patent: Mar. 12, 2002

(54) IMPACT FAN CLUTCH WRENCH

(75) Inventors: James L. Pool, Clarinda, IA (US); Jason C. Jantzer, Phoenix, OR (US)

(73) Assignee: The Lisle Corporation, Clarinda, IA (US)

( * ) Notice: Subject to any disclaimer, the term of this patent is extended or adjusted under 35 U.S.C. 154(b) by 0 days.

(21) Appl. No.: 09/725,612

(22) Filed: Nov. 29, 2000

Related U.S. Application Data

(63) Continuation-in-part of application No. 09/585,968, filed on Jun. 2, 2000.

(51) Int. Cl.[7] ..... B25B 19/00
(52) U.S. Cl. ..... 81/463
(58) Field of Search ..... 81/463, 465, 466; 173/93

(56) References Cited

U.S. PATENT DOCUMENTS 1,923,122 A * 8/1933 Smith ..... 81/463
4,474,091 A * 10/1984 Russ ..... 81/463
5,161,440 A * 11/1992 Jordan ..... 81/463

OTHER PUBLICATIONS

Lisle Corporation catalog, Item No. 41800—Fan Clutch Wrench Set for Ford, 1997, p. 44.*
Lisle Corp. catalog, 1997, p. 44, Item No. 41800—Fan Clutch Wrench Set for Ford.
KD Corp. catalog, Nov. 1997, Item No. 3472—Fan Clutch Wrench Kit.
Lisle product catalog D–57, Lisle Corp. 1997; title page, index page, and p. 44 from Lisle catalog.

* cited by examiner

*Primary Examiner*—Eileen P. Morgan
*Assistant Examiner*—Joni B. Danganan
(74) *Attorney, Agent, or Firm*—Banner & Witcoff, Ltd.

(57) ABSTRACT

A fan clutch wrench set includes multiple driving wrenches which are sized to fit in the restricted space between a fan and an engine block and to engage a fan clutch wrench retention nut inasmuch as the wrench is made from a thin plate of steel. A separate handle includes bifurcated legs which fit over the sides of the flat plate driving wrench and engage a driving surface so as to drive the driving wrench and impart a turning force against the nut.

44 Claims, 3 Drawing Sheets

IMPACT FAN CLUTCH WRENCH

CROSS REFERENCE TO A RELATED APPLICATION

This is a continuation-in-part of application Ser. No. 09/585,968 filed Jun. 2, 2000.

BACKGROUND OF THE INVENTION

In a principal aspect the present invention relates to a fan clutch wrench set, and more particularly to a set of wrenches which are useful for the removal of a fan clutch, associated with the fan of an internal combustion engine, by engaging the nut that retains the fan clutch on its shaft and releasing the nut from the shaft.

Typically, the internal combustion engine of a vehicle includes a fan which facilitates movement of air over the engine and through the engine radiator. The fan may not be operative at all times when the engine is running; for example, when cold during initial start up. Also, certain engines are designed so that the fan will remain operative even though the engine operation has terminated. Such internal combustion engines utilize a fan assembly driven by and connected with a fan drive shaft through a clutch mechanism. Often, this clutch mechanism operates in response to the speed of the engine and/or the temperature of the coolant or engine relative to ambient temperature. In other words, a clutch assembly typically interfaces between the fan and a drive shaft associated with the fan.

The fan is most often positioned at the forward end of a vehicle engine immediately adjacent a radiator, i.e. between a radiator and the engine block. Typically, the space between the fan and the engine or radiator is exceedingly limited. Thus, when attempting to replace the clutch assembly or otherwise repair the fan, it is extremely difficult to engage the nut which retains the fan clutch assembly and loosen that nut so as to permit replacement of the clutch. Consequently, there has developed a need to devise a fan clutch wrench set which enables an auto mechanic to access the clutch retention nut even though space is very limited.

Heretofore, wrenches made from flat plate material have been utilized or suggested for use in removal of a fan clutch retaining nut. Such wrenches usually require a very long lever arm in order to obtain an appropriate mechanical advantage to effect removal of the fan clutch retention nut. Often, within the engine compartment, however, there is limited room for such a wrench. Additionally, each engine size and brand typically has its own unique fan clutch wrench nut construction. That is, the size and/or shape of the retention nut may vary. Thus, there is a need to have either a rather large set of long handled flat plate wrenches, or to have some type of wrench that may be easily adjusted to accommodate various retention nut sizes. Consequently, there is a need for an improved fan clutch wrench set or construction.

SUMMARY OF THE INVENTION

Briefly, the present invention comprises a fan clutch wrench set which includes two basic component parts, a nut driving wrench and a drive handle. The nut driving wrench part of the set may be easily substituted to accommodate a fan clutch wrench retention nut of any size or shape. The nut driving wrench part or element of the set is relatively short (5 inches to 10 inches) in length and is formed from a flat metal plate. The nut driving wrench part includes a jaw at one end which fits over a fan clutch retention nut. At the opposite end, the nut driving wrench is configured with an arcuate driving surface which may be located in the plate or along one of the edges or sides of the flat plate forming the nut driving wrench part of the set.

The second element or part of the wrench set, namely the drive handle, is designed to engage against the arcuate driving surface of the nut driving wrench element. The drive handle preferably includes a yoke comprised of bifurcated arms which fit over the sides of the plate comprising the nut driving wrench so that the handle fits against the arcuate surface thereof and is held in that position. Thus, the drive handle is aligned against the drive surface of the driving wrench and a pneumatic tool or other driving device may be impacted against the drive handle to drive the nut driving wrench and thus rotate a fan clutch retention nut.

In one embodiment, a pin connecting the bifurcated arms helps retain the yoke in position by engaging a slot in the end of the nut driving wrench. Multiple nut driving wrenches may be provided in the set, each nut driving wrench having a separate jaw configuration and/or size to thereby accommodate various sized nuts associated with various fan clutch assemblies. Each of the driving wrenches, however, includes a jaw, a lever arm extending from the jaw and an opposite driving end which includes a driving surface that can be engaged by the separate drive handle. In each instance, the driving end of each nut driving wrench which is to be engaged by the drive handle has a substantially identical arcuate configuration and, preferably, a slot for receiving the pin provided in the drive handle yoke which fits over the sides of the nut driving wrench. Alternatively, the drive pin of the drive handle may engage an opening in the driving end of the nut driving wrench to drive the nut driving wrench.

Preferably The arcuate driving surface of the driving wrench and the driving surface of the handle have substantially the same arcuate shape. This facilitates application of uniform force by the handle on the driving wrench.

Thus, it is an object of the invention to provide an improved fan clutch wrench set capable of being utilized in restricted spaces found in an internal combustion engine compartment.

It is a further object of the invention to provide a highly efficient and reasonably priced fan clutch wrench set which is rugged and easy to manipulate and use, especially in restricted spaces.

Further, it is an object of the invention to provide a fan clutch wrench set which may be used in combination with a pneumatic driver or other driving mechanism to detach or unscrew a fan clutch wrench retention nut quickly and easily.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
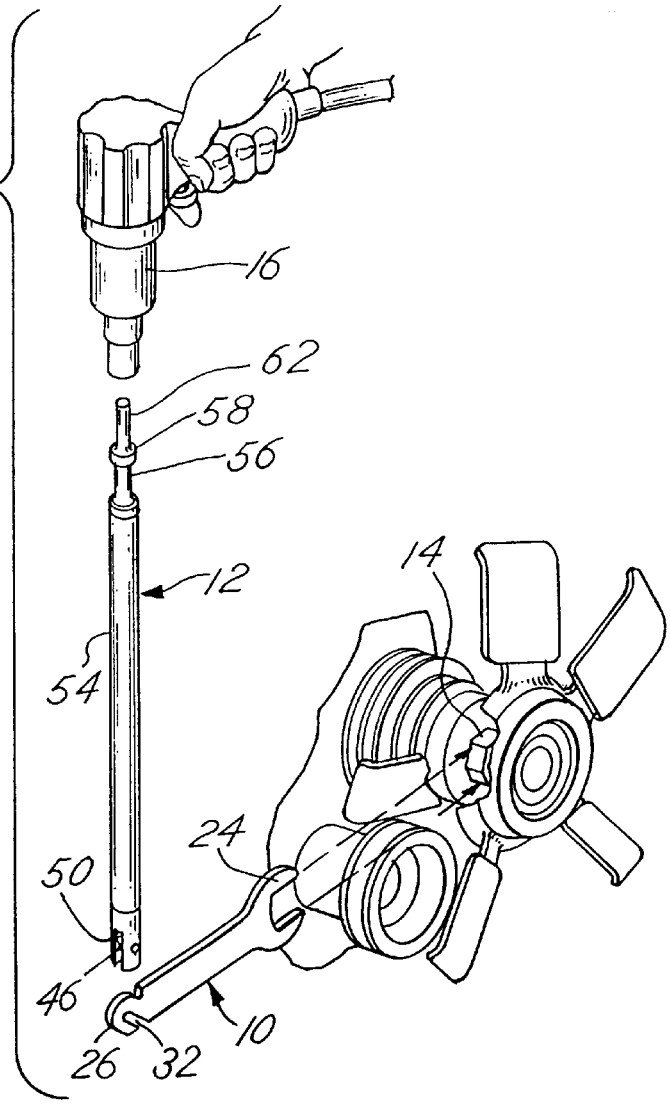
FIG. 1 is an exploded isometric view of the wrench set as it is utilized for loosening or detaching a fan clutch wrench retention nut.
Figure 1:
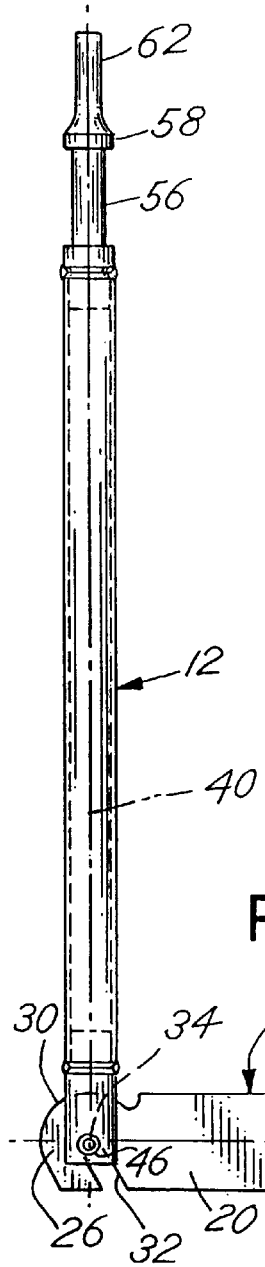

Referring to the figures, the fan clutch wrench set includes a nut driving wrench part or element 10 and a separate drive handle part or element 12. The driving wrench part or driving wrench 10 and drive handle 12 are used in combination to remove a fan clutch wrench retention nut 14, as depicted in FIG. 1, by engaging the nut 14 and turning the nut 14 on its shaft in response to force imparted thereto through the wrench 10 and handle 12, the force being provided, for example, by a pneumatic tool 16 which engages against one end of handle 12.

A plurality of separate driving wrenches 10 may be utilized singly in combination with the universal drive handle 12. That is, the configuration and size of each one of a number of the driving wrenches 10 may be changed or altered to accommodate various sizes of fan clutch wrench retention nuts 14. The jaw of each driving wrench 10, as described in greater detail below, may thus be altered in size, shape, or configuration to accommodate various nut sizes and configurations. Also, the length of a lever arm 20 of the nut driving wrench 10 may be distinct as required or desired. In all circumstances, however, a single drive handle 12 is useful with each and every one of the driving wrenches 10.

Figure 2:
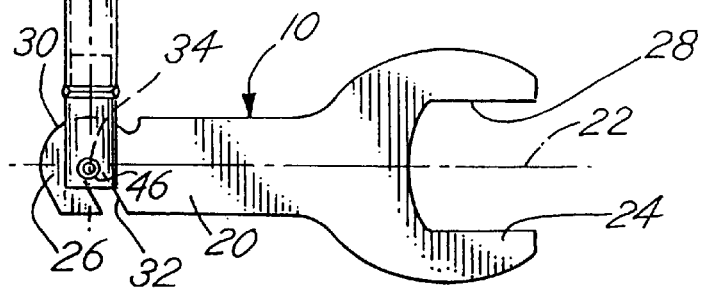
FIG. 2 is a plan view of a fan clutch wrench retention nut driving wrench member in combination with a drive handle thus comprising a fan clutch wrench set.
Figure 3:
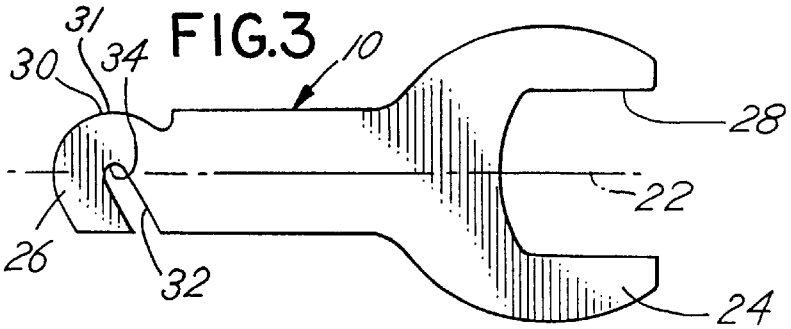
FIG. 3 is a plan view of a typical driving wrench of the set.
Figure 4:
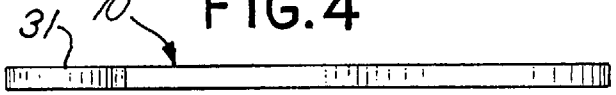
FIG. 4 is a side elevation of the driving wrench of FIG. 3.

Each nut driving wrench 10 thus includes the lever arm 20 with a longitudinal or lever arm axis 22 extending along the length of the lever arm 20. Lever arm 20 is typically 4 inches to 10 inches long. Each driving wrench 10 is made from a flat planar steel plate material and further includes a jaw 24 at one end and a driving or impact end 26. The jaw 24 includes a jaw opening 28 which is configured and sized so as to appropriately engage a compatible retention nut 14 of a fan clutch wrench assembly. Thus, by configuring the jaw opening 28, it is possible to provide a unique driving wrench 10 for each and every retention nut 14. FIG. 2 illustrates one typical driving wrench construction.

The impact or driving end 26 of the driving wrench 10 includes an arcuate surface 30 which is defined along a top edge 31 of the plate comprising the driving wrench 10. The arcuate surface 30 extends along an arc in the range of at least 5° up to 125°. Preferably, the arcuate range is at least 15° and, in a most preferred embodiment, the range extends to as much as 125° of arc and is at least 40° of arc in extent. The arcuate surface 30 is preferably circular in configuration and is centered adjacent or offset from the axis 22.

A longitudinal slot 32 having a uniform width extends upwardly in the impact end 26 toward the arcuate surface 30 from the side opposite the arcuate surface 30. The longitudinal slot 32 terminates with a curved surface 34 which is preferably circular and which is preferably concentric with the center of the arcuate surface 30. The sides of the slot 32 form an angle with the axis 22 in the range of 20° to 120°. Preferably, the sides of uniform width, slot 32 are inclined toward the jaw 24 and form an angle of approximately 60° with the axis 22.

Figure 5:
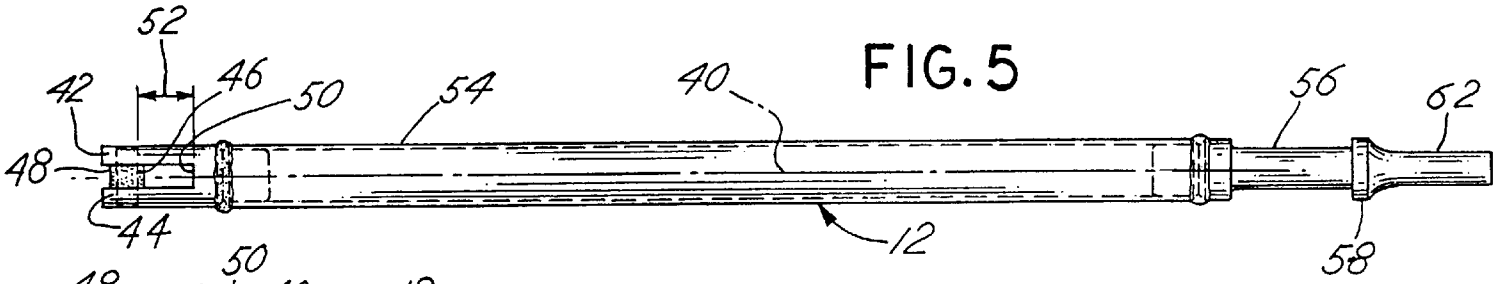
FIG. 5 is a plan view of the drive handle.
Figure 6:
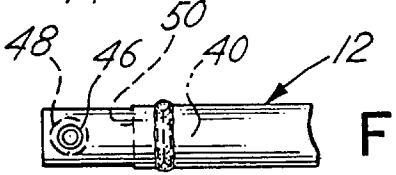
FIG. 6 is a partial plan view of the handle of FIG. 5 rotated by 90°.

The drive handle 12 includes a longitudinal axis 40. At one end of the drive handle 12 are parallel, spaced arms 42 and 44 defining a yoke. The arms 42, 44 are connected by a pin 46 which includes an elastic bushing 48. For example, bushing 48 may comprise a ⅛ inch layer of polyurethane over a ¼ inch diameter pin. Pin 46 is transverse to the axis 40. Arms 42 and 44 are spaced from one another slightly greater than the width of the driving wrench plate 10 so that the arms 42, 44 can easily fit over the plate comprising the wrench 10 and so that the pin 46 with its elastic bushing 48 can slide into the slot 32. The pin 46 is spaced from an upper impact surface 50 defined between the arms 42 and 44 at the top end of the slot defined by those arms 42, 44 at a distance slightly greater than the maximum dimension of the width or distance between the top of the slot 32 and the arcuate surface 30; namely, the dimension exemplified by the distance 52 in FIG. 5. Thus, the pin 46 may easily slide into slot 32 with some space or play available between the surface 50 and the surface 30. The drive handle 12 is typically formed from a steel tube. The arms 42 and 44 may be separately formed on a rod fitted into the tube 54.

Figure 7:
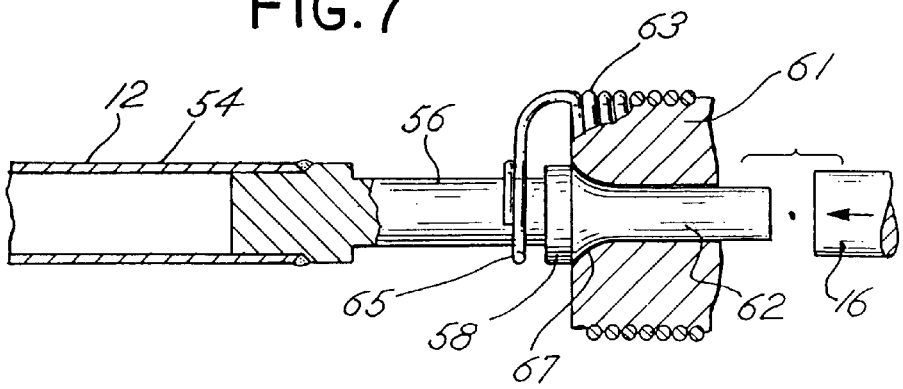
FIG. 7 is a partial plan view of the handle of FIG. 5 in combination with a pneumatic driver.

As depicted in FIG. 7, a ram head or driver head 56 in the form of a rod 62, is positioned and engaged with the tube 54 at the upper end of the handle 12. The head 56 includes a flange 58 so that a pneumatic drive collet 61 of the pneumatic hammer 16 may be fitted over the rod 62 and engage against the flange 58 to impart force thereto. A coil spring 63 threads onto the end of impact tool 16. The free end of the spring 63 is formed as a loop 65 which fits around the head 56 and retains the handle 12 adjacent to a radiused area 67 on the front of the tool 16. The spring 63 keeps the driver handle 12 from falling out of the impact tool 16 and also is a safety device to prevent launching the handle 12 away from the tool 16.

Figure 8:
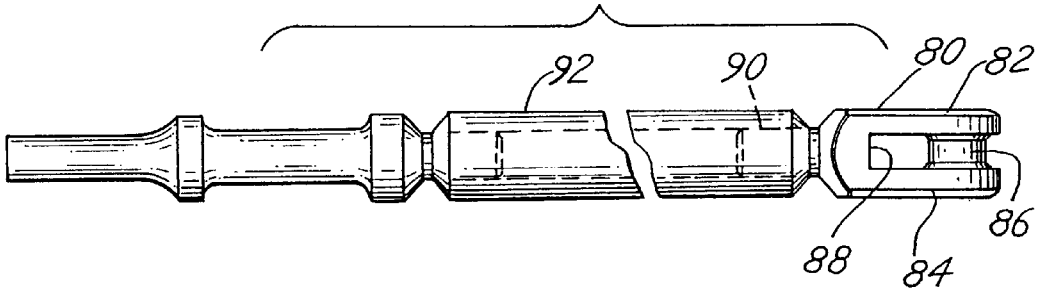
FIG. 8 is a partial cross sectional view of an alternative driving end of the handle wherein the driving end is comprised of an investment cast member.
Figure 9:
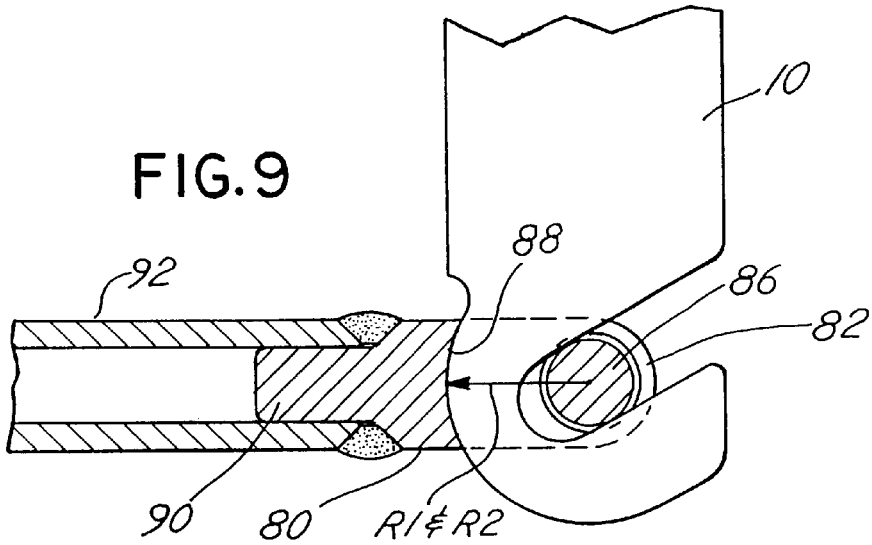
FIG. 9 is a partial cross sectional view of the handle end of FIG. 8 and a typical wrench cooperative with the driving end of the handle.

FIGS. 8 and 9 depict an alternative embodiment of a drive handle 12, and more particularly, the addition of a yoke 80 as depicted in FIGS. 8 and 9 for use with a drive wrench 10, for example, as shown in FIG. 9. Specifically, the yoke 80 is formed by investment casting methods so that a unitary yoke 80 comprises first and second parallel spaced arms 82 and 84 connected by an integral generally cylindrical shaped pin 86 which is spaced from an arcuate engagement surface 88. It is to be noted that the radius of curvature, R1, of the arcuate engagement surface formed by the investment casting method is substantially identical to the radius of curvature R2 of the driving wrench 10. It has been discovered that by matching the radius of curvature of these elements, that a more consistent and continuous driving force may be applied to a nut, for example. The yoke 80 further includes a projecting axial stub or stud 90 which fits within a hollow cylindrical steel tube 92 and may effect alignment of the yoke 80 therewith. The yoke 80 and the tube 92 may be attached one to the other by means of laser welding for example. Laser welding techniques seem to be especially beneficial to the manufacture of such a drive handle.

In practice, an appropriate nut driving wrench 10 is chosen to compatibly fit over the nut 14 of the fan clutch. Typically, the wrench 10 is thin enough to fit between the fan and the fan clutch in the engine compartment and extends radially outwardly from the axis of the nut 14. The drive handle 12 is then positioned so that the impact surface 50 fits against the arcuate surface 30 of driving wrench 10. Impact may then be made against the impact end 56. Impact forces can thus be directed in the clockwise or counterclockwise direction, depending upon the manner and side on which the wrench 10 is affixed to the nut 14. Driving the wrench 10 in this manner will loosen the nut 14 as desired to permit removal of the fan clutch. The process may be reversed and the parts may be reversed in order to cause tightening of the nut 14, if that is so desired or if the nut 14 has reverse threads. Note that the elastic bushing 48 in the first embodiment helps to avoid shear of the pin 46 when handle 12 is intermittently driven and bounces back and forth.

Among the features of the invention which are deemed to be generally important is the inclusion of the arcuate surface 30 or 88 which enables impingement of the drive handle surface 50 in a uniform manner as the wrench 10 turns the nut 14. That is, the handle 12 may be maintained in a vertical position, for example, over a wide range of motion of the wrench 10 as it moves about the axis of the nut 14. Other shapes and configurations connecting the handle 12 and wrench 10 may be utilized. Also, other means for driving the drive wrench may be provided. For example, handle 12 may be a flat plate with a pin 46 projecting from one side inserted through an opening in the impact end 26. The opening may be a throughbore or a slot opening at the top edge of the impact end 26 rather than the bottom edge. Such a pin may then be held in position by a lock ring or lock washer. Various other configurations of the jaw 24 may also be provided. The configuration of the slot 32 and the configuration of the surface 30 are also variable as desired. As stated above, the nut driving wrench 10 may be one element from a large set of such wrenches, each wrench being customized to fit on a particular nut and for a particular engine compartment. The shape of the jaw opening 28, the length of arm 20 and other features of each wrench 10 are thus customized, although each wrench 10 may be separately used with handle 12. With the preferred embodiment, which utilizes a slot 32 and drive surface 30, quick exchange of wrenches 10 is thus functionally enhanced. Thus, the invention is to be limited only by the following claims and equivalents thereof.

What is claimed is:

1. A fan clutch wrench set comprising, in combination:

(a) a plurality of driving wrenches, each driving wrench having a lever arm defining a lever arm axis with a drive head end and an opposite impact end, said ends being generally aligned on the axis, said drive head end including a jaw configuration for engaging a fan clutch retention nut, said impact end including an arcuate outside driving surface extending over a sector greater than 15°; and (b) a drive handle having a longitudinal axis, a ram end at one end of the handle and a yoke at the opposite end, said yoke including a drive face transverse to the longitudinal axis and spaced legs on opposite sides of the drive face for fitting over the impact end of the driving wrench with the drive face against the arcuate outside driving surface, whereby the drive head end may be placed over a nut and the drive handle yoke positioned on the impact end as the ram end is engaged to impart a turning force to the nut through the lever arm.

2. The fan clutch wrench set of claim 2 wherein the impact end of the driving wrench includes a slot opposite to the arcuate surface, and wherein the yoke of the drive handle includes a pin between the legs for fitting into the slot when the drive handle is engaged with the driving wrench.

3. The fan clutch wrench set of claim 2 including a plurality of separate driving wrenches, each separate driving wrench having a distinct jaw configuration.

4. The fan clutch wrench set of claim 2 wherein the slot forms an angle with the driving wrench axis in the range of about 20° to 120°.

5. The fan clutch wrench set of claim 2 wherein the slot includes an arcuate end with a center.

6. The fan clutch wrench set of claim 1 or 5 wherein the center of the arcuate surface is offset from the driving wrench axis.

7. The fan clutch wrench set of claim 5 wherein the arcuate surface is concentric with the center of the arcuate end of the slot.

8. The fan clutch wrench set of claim 1 or 2 wherein the driving wrench is in the form of a flat plate.

9. The fan clutch wrench set of claim 2 wherein the pin includes an elastic material surface layer.

10. The fan clutch wrench set of claim 1 wherein the arcuate driving surface has an arcuate extent greater than 90°.

11. A fan clutch wrench set comprising, in combination:

(a) a driving wrench in the form of a flat plate with a top edge, said plate defining a lever arm with a nut engaging jaw at one end and an impact surface at the opposite end, said opposite end including a slot; and (b) a drive handle having a longitudinal axis with a first end for receiving a ram force and a second end for engaging the impact surface of the driving wrench said second end including a pin for engaging the driving wrench slot and holding the drive handle engaged with the driving wrench.

12. The wrench set of claim 1 or 11 further including a drive tool for engaging the drive handle and a retention member for coupling the tool to the drive handle.

13. The fan clutch wrench set of claim 12 wherein the drive handle second end includes a yoke with spaced legs to fit on opposite sides of the plate to hold the handle on the plate.

14. The fan clutch wrench set of claim 12 wherein the impact surface is an arcuate surface on the top edge.

15. The fan clutch wrench set of claim 12 or 14 wherein the second end includes an impact surface transverse to the longitudinal axis.

16. The fan clutch wrench set of claim 12 wherein the second end includes a yoke with spaced legs for fitting over the sides of the plate.

17. The fan clutch wrench set of claim 12 wherein the drive handle includes a yoke with an engagement surface for engaging the impact surface and wherein the engagement surface and the impact surface each have a radius of curvature and each have the same radius of curvature.

18. A fan clutch wrench set comprising, in combination:

(a) a driving wrench having a lever arm defining a lever arm axis with a drive head end and an opposite impact end, said ends being generally aligned on the axis, said drive head end including a jaw configuration for engaging a fan clutch retention nut, said impact end including an arcuate outside driving surface extending over a sector greater than about 15°, said impact end including a slot opposite the arcuate surface, and;

(b) a drive handle having a longitudinal axis, a ram end at one end of the handle and a yoke at the opposite end, said yoke including a drive face transverse to the longitudinal axis and spaced legs on opposite sides of the drive face for fitting over the impact end of the driving wrench with the drive face against the arcuate outside driving surface, whereby the drive head end may be placed over a nut and the drive handle yoke positioned on the impact end as the ram end is engaged to impart a turning force to the nut through the lever arm, said yoke including a pin between the legs for fitting into the driving wrench slot.

19. The fan clutch wrench set of claim 18 including a plurality of separate driving wrenches, each separate driving wrench having a distinct jaw configuration.

20. The fan clutch wrench set of claim 18 wherein the arcuate driving surface has an arcuate extent greater than 90°.

21. The fan clutch wrench set of claim 18 wherein the slot forms an angle with the driving wrench axis in the range of about 20° to 120°.

22. The fan clutch wrench set of claim 18 wherein the slot includes an arcuate end with a center.

23. The fan clutch wrench set of claim 22 wherein the arcuate surface is concentric with the center of the arcuate end of the slot.

24. The fan clutch wrench set of claim 18 wherein the center of the arcuate surface is offset from the driving wrench axis.

25. The fan clutch wrench set of claim 18 wherein the driving wrench is in the form of a flat plate.

26. The fan clutch wrench set of claim 18 wherein the pin includes an elastic material surface layer.

27. A fan clutch wrench set comprising, in combination:

(a) a driving wrench in the form of a flat plate with a top edge, said plate defining a lever arm with a nut engaging jaw at one end and an impact surface at the opposite end;

(b) a drive handle having a longitudinal axis with a first end for receiving a ram force and a second end for engaging the impact surface of the driving wrench;

(c) a drive tool for engaging the drive handle; and (d) a retention member for coupling the drive tool to the drive handle.

28. The fan clutch wrench set of claim 27 wherein the drive handle second end includes a yoke with spaced legs to fit on opposite sides of the plate to hold the handle on the plate.

29. The fan clutch wrench set of claim 27 wherein the driving wrench opposite end includes a slot and the second end of the drive handle includes a pin for engaging the slot and holding the drive handle engaged with the driving wrench.

30. The fan clutch wrench set of claim 27 wherein the impact surface is an arcuate surface on the top edge.

31. The fan clutch wrench set of claim 27 wherein the second end includes an impact surface transverse to the longitudinal axis.

32. The fan clutch wrench set of claim 27 including a slot in the opposite end of the driving wrench and a pin in the second end of the drive handle for engaging the slot.

33. The fan clutch wrench set of claim 32 wherein the second end includes a yoke with spaced legs for fitting over the sides of the plate.

34. The fan clutch wrench set of claim 27 wherein the drive handle includes a yoke with an engagement surface for engaging the impact surface and wherein the engagement surface and the impact surface each have a radius of curvature and each have the same radius of curvature.

35. A fan clutch wrench set comprising, in combination:

(a) a driving wrench in the form of a flat plate having a lever arm defining a lever arm axis with a drive head end and an opposite impact end, said ends being generally aligned on the axis, said drive head end including a jaw configuration for engaging a fan clutch retention nut, said impact end including an arcuate outside driving surface extending over a sector greater than 15°; and (b) a drive handle having a longitudinal axis, a ram end at one end of the handle and a yoke at the opposite end, said yoke including a drive face transverse to the longitudinal axis and spaced legs on opposite sides of the drive face for fitting over the impact end of the driving wrench with the drive face against the arcuate outside driving surface, whereby the drive head end may be placed over a nut and the drive handle yoke positioned on the impact end as the ram end is engaged to impart a turning force to the nut through the lever arm.

36. The fan clutch wrench set of claim 35 wherein the impact end of the driving wrench includes a slot opposite to the arcuate surface, and wherein the yoke of the drive handle includes a pin between the legs for fitting into the slot when the drive handle is engaged with the driving wrench.

37. The fan clutch wrench set of claim 36 wherein the slot forms an angle with the driving wrench axis in the range of about 20° to 120°.

38. The fan clutch wrench set of claim 36 wherein the slot includes an arcuate end with a center.

39. The fan clutch wrench set of claim 38 wherein the arcuate surface is concentric with the center of the arcuate end of the slot.

40. The fan clutch wrench set of claim 35 including a plurality of separate driving wrenches, each separate driving wrench having a distinct jaw configuration.

41. The fan clutch wrench set of claim 35 wherein the arcuate driving surface has an arcuate extent greater than 90°.

42. The fan clutch wrench set of claim 35 wherein the center of the arcuate surface is offset from the driving wrench axis.

43. The fan clutch wrench set of claim 35 wherein the driving wrench is in the form of a flat plate.

44. The fan clutch wrench set of claim 35 wherein the pin includes an elastic material surface layer.

* * * * *